US007967620B1

(12) United States Patent
Baldwin et al.

(10) Patent No.: US 7,967,620 B1
(45) Date of Patent: Jun. 28, 2011

(54) SAFETY OUTLET

(75) Inventors: Jeffrey P. Baldwin, Phoenix, AZ (US); Marcus J. Shotey, Scottsdale, AZ (US)

(73) Assignee: TayMac Corporation, Gilbert, AZ (US)

( * ) Notice: Subject to any disclaimer, the term of this patent is extended or adjusted under 35 U.S.C. 154(b) by 0 days.

(21) Appl. No.: 12/552,973

(22) Filed: Sep. 2, 2009

Related U.S. Application Data

(60) Provisional application No. 61/093,501, filed on Sep. 2, 2008.

(51) Int. Cl.
*H01R 29/00* (2006.01)

(52) U.S. Cl. ..... 439/188

(58) Field of Classification Search ..... 439/188; 200/51.09
See application file for complete search history.

(56) References Cited

U.S. PATENT DOCUMENTS 5,277,602 A * 1/1994 Yi ..... 439/138
5,551,884 A * 9/1996 Burkhart, Sr. ..... 439/140

* cited by examiner

*Primary Examiner* — Phuong K Dinh
(74) *Attorney, Agent, or Firm* — Booth Udall, PLC

(57) ABSTRACT

A safety outlet comprises an electrical outlet having both hot and neutral plug blade apertures each with respective output contacts and input contacts associated. A safety tab is disposed adjacent each of the respective output contacts and the input contacts and is positionable between a disengaged position and an engaged position. In the engaged position, the output contacts and the input contacts of the respective plug blade apertures are electrically isolated from each other. In the disengaged position, the output contacts and the input contacts of each of the respective plug blade apertures are in electrically conductive contact to complete a respective hot plug blade circuit and a respective neutral plug blade circuit to activate the respective hot and neutral plug blade apertures. The safety tabs are operatively responsive to move to its disengaged position when a plug blade is positioned within the respective aperture.

7 Claims, 7 Drawing Sheets

SAFETY OUTLET

CROSS REFERENCE TO RELATED APPLICATIONS

This document claims the benefit of the filing date of U.S. Provisional Patent Application 61/093,501 to Baldwin, et al. entitled "Safety Outlet", which was filed on Sep. 2, 2008, the disclosure of which is hereby incorporated herein by reference.

BACKGROUND

1. Technical Field

Aspects of the present documents relate generally to safety outlets.

2. Background Art

Many residential and commercial buildings include one or more electrical outlets. While electrical outlets may provide a convenient and easy way for electrical customers to access an electrical supply, their easy accessibility may pose risks to children or others who attempt to insert items other than an appropriate electrical plug into an electrical outlet.

SUMMARY

Aspects of this document relate generally to safety outlets.

In one aspect, a safety outlet comprises an electrical outlet having at least a first plug blade aperture and a second plug blade aperture, each of the first and second blade apertures having associated therewith at least one electrically conductive output contact, at least one electrically conductive input contact and at least one safety tab moveably associated with its respective plug blade aperture. Each of the at least one safety tab is operatively responsive to an electrical plug blade being pushed into its respective first or second plug blade aperture, each respective safety tab responsive to move from an engaged position in which an association between the respective safety tab, output contact and input contact is such that the respective output contact and input contact are not in electrical communication, to a disengaged position in which the association between the respective safety tab, output contact and input contact is such that the respective output contact and input contact are in electrical communication. The electrical outlet is configured such that electrical power is not supplied to either of the first and second plug blade apertures until the safety tabs associated with both the first and the second plug blade apertures are moved to their disengaged positions.

In particular implementations, safety outlets may include one or more of the following: In the engaged position of each respective safety tab at least one of the respective output contact and input contact may be biased toward the other and the respective safety tab may be between the respective output contact and input contact. In its disengaged position each respective safety tab may not be between the respective output contact and input contact. Each respective safety tab may be slidably moveable between the engaged position and the disengaged position. Each respective safety tab may be biased to its engaged position. Each of the respective safety tabs may be independently moveable in relation to the others. Each respective safety tab may be slidably moveable between the engaged position and the disengaged position and may be biased to its engaged position. When each respective safety tab is moved from its engaged position to its disengaged position, the safety tab may activate a switch which when activated electrically couples its respective output contact to its respective input contact. When the electrical plug blade is inserted into the first plug blade aperture and the respective safety tab is in its disengaged position, the respective output contact and respective input contact may be in electrical communication through the electrical plug blade. Each respective safety tab may be pivotally moveable between the engaged position and the disengaged position. The electrically conductive output contact associated with the second plug blade aperture may be electrically coupled to the electrically conductive input contact associated with the first plug blade aperture.

In particular implementations, a safety outlet may further comprise a timing circuit associated with the safety tabs and configured such that if the safety tab associated with the first plug blade aperture is moved to its disengaged position in time relation to the safety tab associated with the second plug blade aperture longer than a predetermined time interval, electrical power is not supplied to either of the first or second plug blade apertures. In particular implementations, a safety outlet may further comprise an alarm operatively associated with the electrical outlet, the alarm configured to indicate when one but not both of the safety tabs associated with the first and second plug blade apertures is moved to its disengaged position. In particular implementations, a safety outlet may further comprise an alarm operatively associated with the electrical outlet, the alarm configured to indicate when the safety tab associated with the second plug blade aperture is not moved to its disengaged position within a predetermined time interval after the safety tab associated with the first plug blade aperture is moved to its disengaged position.

In another aspect, a safety outlet comprises an electrical outlet having at least a hot plug blade aperture comprising a hot output contact and a hot input contact normally not in electrically conductive contact, and a hot safety tab, at least a neutral plug blade aperture comprising a neutral output contact and a neutral input contact normally not in electrically conductive contact, and a neutral safety tab. The hot safety tab may be operatively responsive to an electrical plug blade being pushed into the hot plug blade aperture, the hot safety tab being responsive to move from an engaged position in which the associated hot output contact and hot input contact are not in electrically conductive contact with each other, to a disengaged position in which the associated hot output contact and hot input contact are in electrically conductive contact with each other. The neutral safety tab may be operatively responsive to an electrical plug blade being pushed into the neutral plug blade aperture, the neutral safety tab responsive to move from an engaged position in which the associated neutral output contact and neutral input contact are not in electrically conductive contact with each other, to a disengaged position in which the associated neutral output contact and neutral input contact are in electrically conductive contact with each other. The neutral input contact may be electrically coupled with a hot input line and the neutral output contact may be electrically coupled with the hot input contact such that the hot output contact electrically couples with the hot input line through the hot neutral input contact.

In particular implementations, a safety outlet may comprise one or more of the following: The hot input contact may be normally not in electrically conductive contact with the hot output contact because the hot safety tab is insulative and is biased to its engaged position, which engaged position is between the hot input contact and hot output contact. When the hot safety tab is in its disengaged position the hot output contact and hot input contact may be in electrically conductive contact with each other because the hot safety tab pushes the hot input contact toward the hot output contact or pushes the hot output contact toward the hot input contact or pushes the hot output contact and the hot input contact together. The hot safety tab may be electrically insulative and pivotably moveable between the engaged position and the disengaged position. The hot safety tab may be biased to its engaged position and slidably moveable between the engaged position and the disengaged position. When the hot safety tab is moved from its engaged position to its disengaged position, the hot safety tab may activate a switch which when activated electrically couples the hot output contact to the hot input contact. When the electrical plug blade is pushed into the hot plug blade aperture and the hot safety tab is in its disengaged position, the hot output contact and hot input contact may be in electrical communication through the electrical plug blade.

In particular implementations, a safety outlet may further comprise a timing circuit associated with the hot safety tab and configured such that if the hot safety tab is moved to its disengaged position in time relation to the neutral safety tab longer than a predetermined time interval, electrical power is not supplied to the hot plug blade aperture. In particular implementations, a safety outlet may further comprise an alarm operatively associated with the hot safety tab, the alarm configured to indicate when the hot safety tab is not moved to its disengaged position within the predetermined time interval of the neutral safety tab being moved to its disengaged position. In particular implementations, a safety outlet may In another aspect, a method of activating a safety electrical outlet comprises inserting a blade of an electrical plug into each of a hot plug blade aperture and a neutral plug blade aperture of a safety electrical outlet and moving an electrically insulative safety tab within each of the hot plug blade aperture and the neutral plug blade aperture from an engaged position to a disengaged position, wherein movement of no less than both safety tabs activates the safety electrical outlet.

In particular implementations, the method may further comprise one or more of the following: Moving the electrically insulative safety tabs comprising: completing a hot plug blade aperture circuit to activate the hot plug bade aperture by moving the safety tab located within the hot plug blade aperture in response to the plug blade inserted into the hot plug blade aperture, wherein moving comprises moving the safety tab within the hot plug blade from an engaged position wherein a hot output contact and a hot input contact are not in electrical communication, to a disengaged position wherein the hot output contact and hot input contact are in electrical communication. Moving the electrically insulative safety tabs comprising completing a neutral plug blade aperture circuit to activate the neutral plug bade aperture by moving the safety tab located within the neutral plug blade aperture in response to the plug blade inserted into the neutral plug blade aperture, wherein moving comprises moving the safety tab within the neutral plug blade from an engaged position wherein a neutral output contact and a neutral input contact are not in electrical communication, to a disengaged position wherein the neutral output contact and neutral input contact are in electrical communication. Moving the electrically insulative safety tab within each of the hot plug blade aperture and the neutral plug blade aperture comprising: moving the insulative tabs from the engaged position wherein the safety tabs are between respective hot input contact and hot output contact, and respective neutral input contact and neutral output contact.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

A safety outlet will hereinafter be described in conjunction with the appended drawings, where like designations denote like elements, and.

DESCRIPTION

Figure 1:
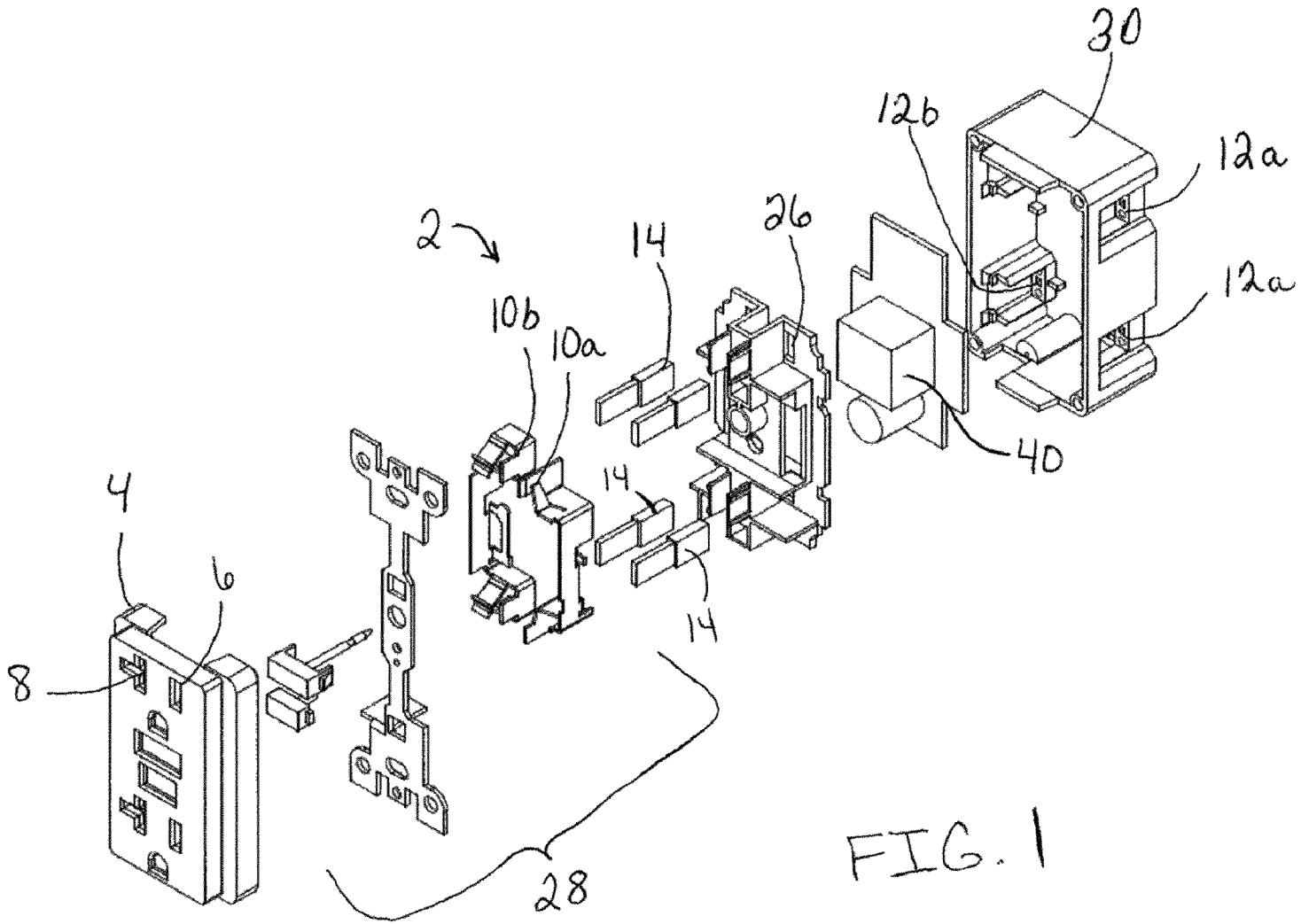
FIG. 1 is an exploded perspective view of a particular implementation of a safety outlet.

This disclosure, its aspects and implementations, are not limited to the specific components or assembly procedures disclosed herein. Many additional components and assembly procedures known in the art consistent with the intended operation of a safety outlet and/or assembly procedures for a safety outlet will become apparent from this disclosure. Accordingly, for example, although particular electrical outlets, hot plug blade apertures, neutral plug blade apertures, output contacts, input contacts, safety tabs, hot safety tabs, neutral safety tabs, disengaged positions, engaged positions, hot plug blade circuits, neutral plug blade circuits; electrical plugs, electrical plug blades, timing circuits, alarms, ground fault interrupter assemblies, base boxes, through slots, and implementing components are described, such electrical outlets, hot plug blade apertures, neutral plug blade apertures, output contacts, input contacts, safety tabs, hot safety tabs, neutral safety tabs, disengaged positions, engaged positions, hot plug blade circuits, neutral plug blade circuits; electrical plugs, electrical plug blades, timing circuits, alarms, ground fault interrupter assemblies, base boxes, through slots may comprise any shape, size, style, type, model, version, measurement, concentration, material, quantity, and/or the like as is known in the art for such safety outlets, consistent with the intended operation of a safety outlet.

There are a variety of safety outlet implementations contemplated, disclosed herein, and made clear from the present disclosure. FIGS. 1-6 illustrate various aspects of particular implementations of a safety outlet. A safety outlet 2 comprises an electrical outlet 4 having at least a hot plug blade aperture 6 and a neutral plug blade aperture 8, each aperture sized and shaped to respectively accept therein a conductive plug blade 20 of an electrical plug 24 (e.g. a hot plug blade 20*a* and a neutral plug blade 20*b*, respectively). An electrical outlet 4 may likewise comprise one or more auxiliary apertures to allow the passage therethrough of one or more "test" buttons and/or one or more "reset" buttons commonly associated with a ground fault interrupter assembly 28 that is known in the art. One or more output contacts 10*a*, 10*b* (which may include one or more hot output contacts 10*a* and one or more neutral output contacts 10*b*) are associated with each of the hot plug blade aperture 6 and the neutral plug blade aperture 8. Operation of conventional electrical outlets and ground fault interrupt circuits (GFCI) are well known in the art. Those of ordinary skill in the art will readily understand how to adapt the teachings of this disclosure relating to the use of moveable safety tabs and other safety outlet improvements to use with otherwise conventional outlet and GFCI outlet designs.

The one or more output contacts 10*a*, 10*b* selectively mate with a conducive plug blade 20 to allow distribution of electricity to an electrical plug 24. For example, the one or more output contacts 10*a*, 10*b* associated with a hot plug blade aperture 6 will selectively mate with a hot plug blade 20*a* (FIGS. 5 and 6), and the one or more output contacts 10*a*, 10*b* associated with a neutral plug blade aperture 8 will selectively mate with a neutral plug blade 20*b*. In addition, one or more input contacts 12*a*, 12*b* (which may include one or more hot input contacts 12*a* and one or more neutral input contacts 12*b*) for accepting an electrical supply from external wiring are also associated with each of the hot plug blade aperture 6 and the neutral plug blade aperture 8.

Figure 5:
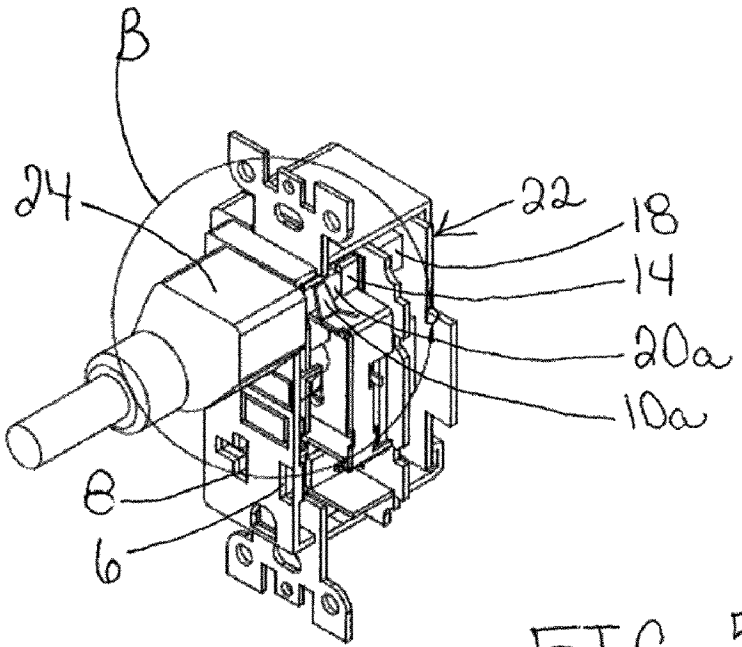
FIG. 5 is an in-use cut-away view of a particular implementation of a safety outlet.
Figure 6:
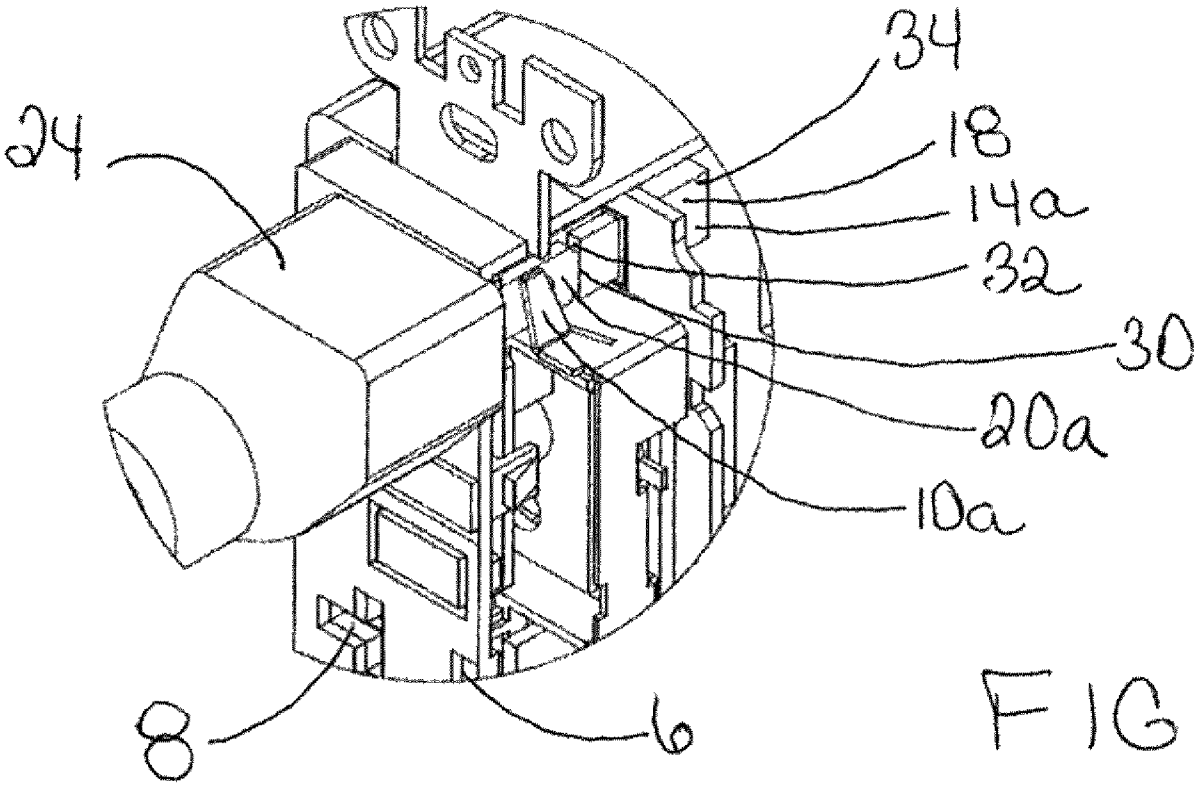
FIG. 6 is a detail view of detail section "B" of FIG. 5.

In a particular implementation illustrated in FIGS. 3-6, one or more insulative safety tabs 14 is disposed between each of the one or more output contacts 10*a*, 10*b* and the one or more input contacts 12*a*, 12*b* of both the hot plug blade aperture 6 and the neutral plug blade aperture 8. Each of the one or more safety tabs 14 is positionable between an engaged position 16 (FIGS. 3 and 4) and a disengaged position 18 (FIGS. 5 and 6). Although the particular implementation illustrated in FIGS. 3-6 includes safety tabs 14 associated with both the hot and neutral contacts, other particular implementations may comprise safety tabs associated with only the hot contacts 10*a*, 12*a* or the neutral contacts 10*b*, 12*b*. In the particular implementation illustrated in FIGS. 5 and 6, when one or more safety tabs 14 is in the disengaged position 18, one or more output contacts 10*a*, 10*b* and one or more input contacts 12*a*, 12*b* associated with each of the hot plug blade aperture 6 and the neutral plug blade aperture 8 are electrically coupled together so as to complete a respective hot plug blade circuit and a respective neutral plug blade circuit. Alternatively, in other particular implementations where the safety tab 14 does not extend between the respective input 12*a* or 12*b* and output 10*a* or 10*b* contacts to complete the respective circuits, movement of the safety tab to its disengaged position by moving it out from between the respective input 12*a* or 12*b* and output 10*a* or 10*b* contacts may allow the respective input 12*a* or 12*b* and output 10*a* or 10*b* contacts to directly contact each other to complete each respective hot or neutral plug blade circuit by allowing the output contact 10*a* or 10*b* to press against its corresponding input contact 12*a* or 12*b* based on one or both of the input 12*a* or 12*b* and output 10*a* or 10*b* contacts being biased toward the other respective output 10*a* or 10*b* and input 12*a* or 12*b* contacts.

Figure 7:
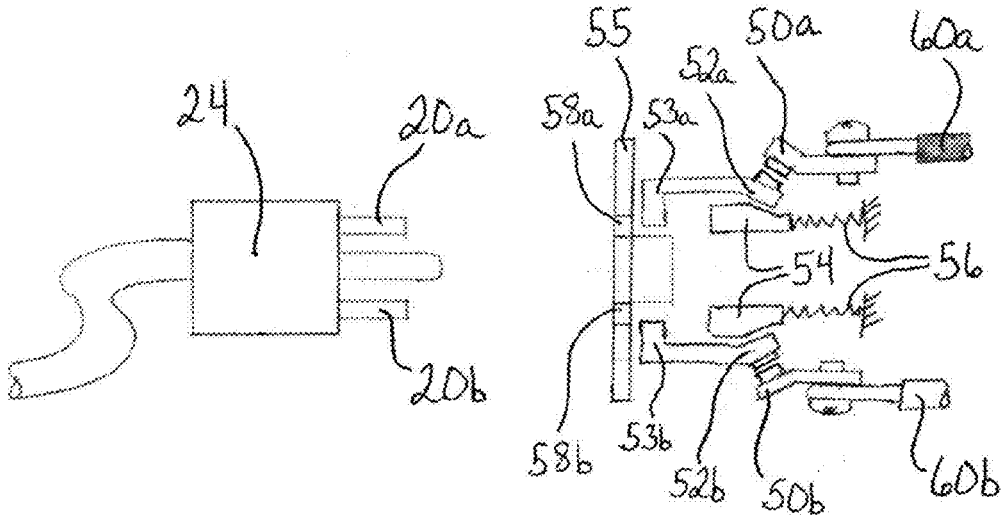
FIG. 7 is a first representative internal circuit diagram of a particular implementation of a safety outlet.
Figure 8:
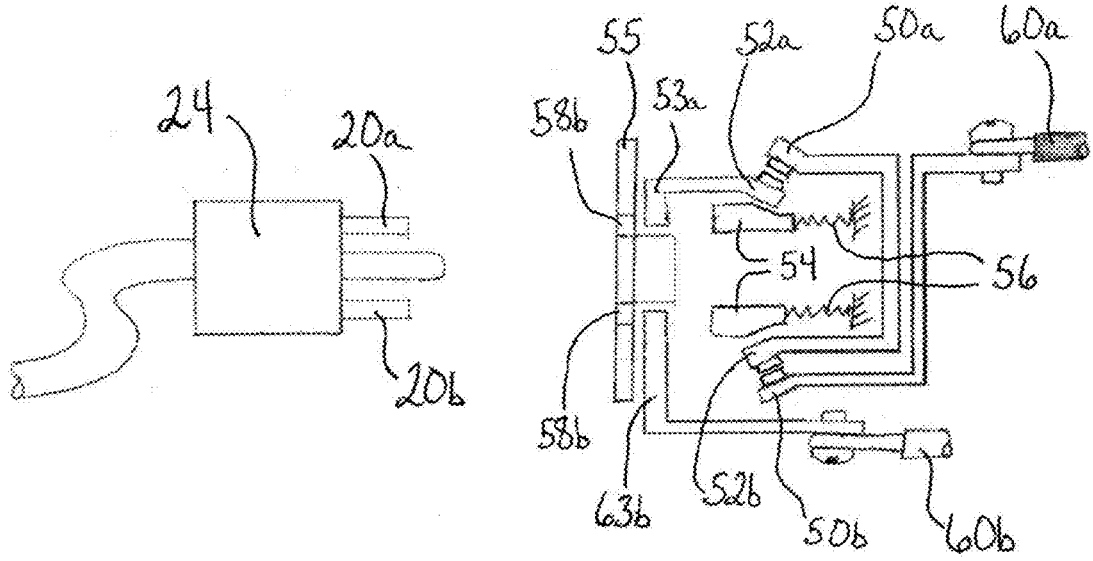
FIG. 8 is a second representative internal circuit diagram of another particular implementation of a safety outlet.
Figure 9:
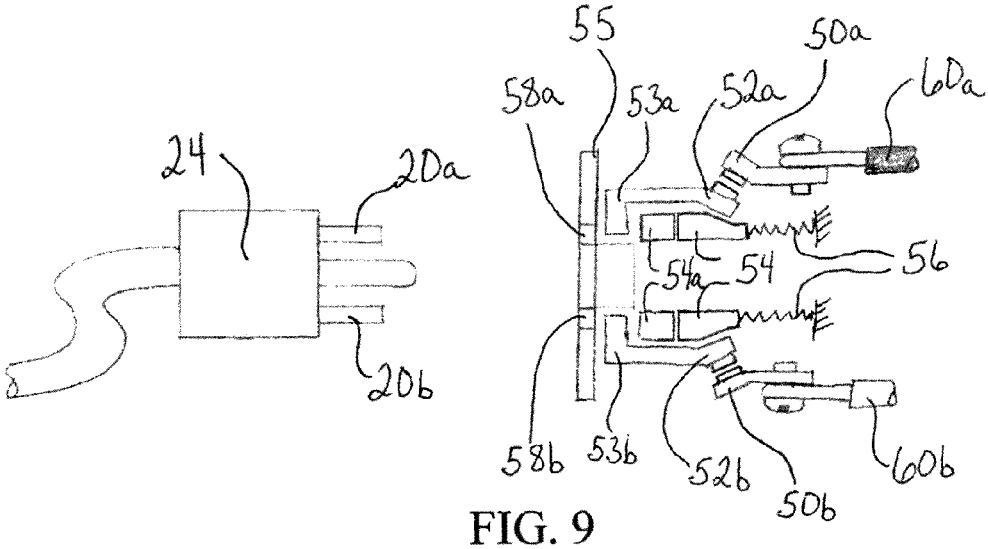
FIG. 9 is a third representative internal circuit diagram of another particular implementation of a safety outlet.

FIGS. 7-10 illustrate a variety of representative illustrations of how the safety tabs may be associated with the respective input and output contacts for non-limiting implementations where the safety tab pushes the output and input contacts together (disengaged position) when it is moved by the electrical plug blade. For each of the various implementations shown in FIGS. 7-10, the safety tabs 54 are coupled at a first end to a spring 56 biasing the safety tab toward the outlet face 55 (engaged position). The outlet face 55 comprises a hot blade aperture 58*a* and a neutral blade aperture 58*b* for receiving respective hot plug blade 20*a* and hot plug blade 20*b*. For the particular implementations of FIGS. 9 and 10, the safety tabs 54 comprise multiple parts 54 and 54*a* to illustrate that various parts of the safety tabs 54, 54*a* may be formed as a single component or multiple components of the same or different materials depending upon the practical needs of a given implementation. Whether one or multiple parts, the operation is essentially the same. FIGS. 7 and 9 each illustrate implementations where the safety tabs 54 may push other components to receive pressure from the respective plug blades 20*a*, 20*b* and press the respective output 52*a*, 52*b* and input 50*a*, 50*b* contacts together. If the circuit is active, power is supplied to the respective output contacts 52*a*, 52*b* and is conducted to the respective plug blades 20*a*, 20*b* through the respective outputs 53*a*, 53*b*, 63*b* which couple with the respective plug blades 20*a*, 20*b* when they are inserted into the respective plug blade apertures 58*a*, 58*b*.

For the particular implementations of FIGS. 7-10, each of the hot 58*a* and neutral 58*b* plug blade apertures includes an associated moveable output 52*a*, 52*b* and an associated input 50*a*, 50*b*. When a respective hot 20*a* or neutral 20*b* plug blade is inserted into the respective hot 58*a* or neutral 58*b* plug blade aperture, the respective plug blade 20*a*, 20*b* pushes against its associated safety tab 54, 54*a* which in turn pushes against its respective moveable output 52*a*, 52*b* which moves toward its respective input 50*a*, 50*b*. The moveable outputs 52*a*, 52*b* may move in any way known in the art such as by sliding, flexing, bending and the like. For the specific examples shown in FIGS. 7-10, the moveable outputs 52*a*, 52*b* flex toward the inputs 50*a*, 50*b* to make contact. When the respective plug blade 20*a*, 20*b* is removed, the springs 56 bias the safety tabs 54, 54*a* away from the moveable outputs 52*a*, 52*b* which allows them to return to their rest position where the outputs 52*a*, 52*b* and inputs 50*a*, 50*b* are not in electrically conductive contact.

Movement of the moveable outputs 52*a*, 52*b* may occur by placement of the output and input contacts near the safety tabs 54 so they are pressed together (as in FIG. 8), or by placing them elsewhere along the travel path of the safety tabs 54. Alternatively, though not expressly shown in the implementations of FIGS. 5-8, the respective output 10*a* or 10*b*, 50*a* or 50*b* and input 12*a* or 12*b*, 52*a* or 52*b* contacts may be placed in electrically conductive contact through discrete switches that are then activated by the safety tabs 14, 54 being moved to the disengaged position.

Figure 10:
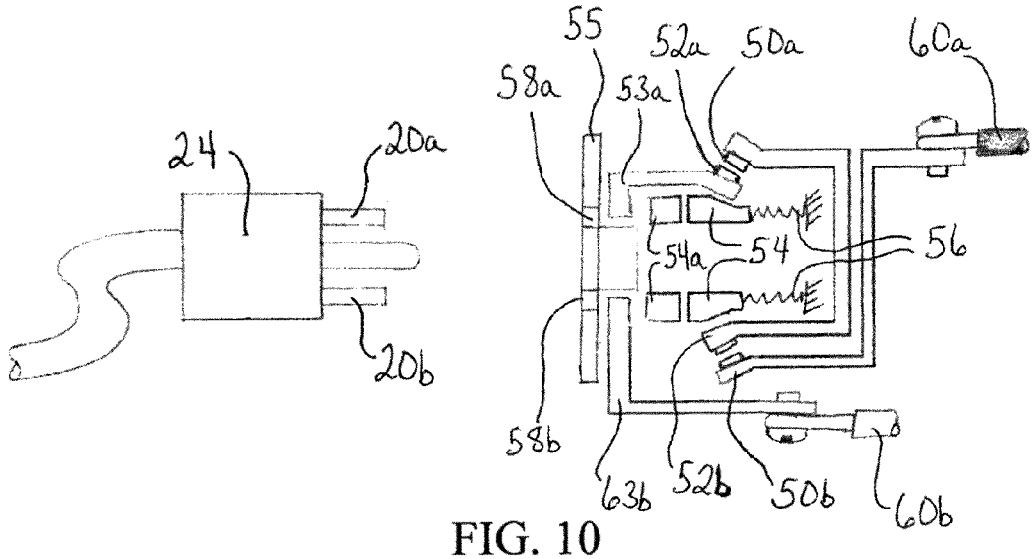
FIG. 10 is a fourth representative internal circuit diagram of another particular implementation of a safety outlet.
Figure 11:
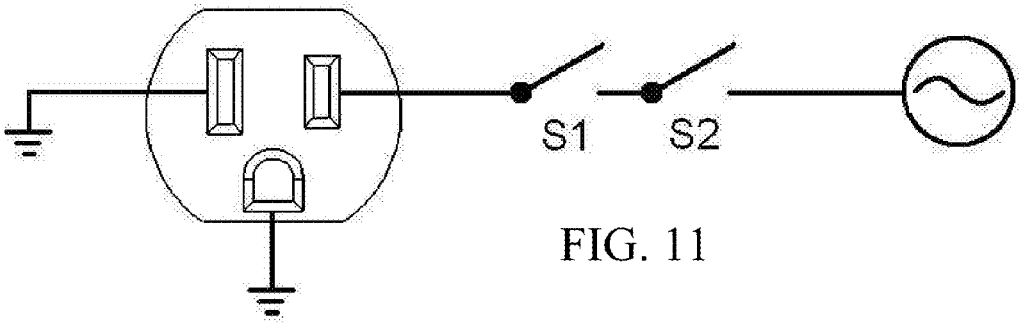
FIG. 11 is a representative circuit diagram.

The particular implementations of FIGS. 7 and 9 differ slightly from the particular implementations of FIGS. 8 and 10 in that in FIGS. 7 and 9, hot output 52*a* and hot input 50*a* contacts, when electrically coupled, are directly coupled with the hot power line 60*a*, and neutral output 52*b* and neutral input 50*b* contacts, when electrically coupled, are directly coupled with the neutral power line 60*b*. As a result, the hot output 53*a* is electrically coupled to the hot power line 60*a* when the safety tab 54 presses the hot output contact 52*a* against the hot input contact 50*a*, and the neutral output 53*b* is electrically coupled to the neutral power line 60*b* when the safety tab 54 presses the neutral output contact 52*b* against the neutral input contact 50*b*. Alternatively, as illustrated in FIGS. 8 and 10, the internal circuitry may be configured so that the hot output 53*a* is not electrically coupled to the hot input line 60*a* unless both the hot output 52*a* and neutral output 52*b* contacts are electrically coupled with their respective hot input 50*a* and neutral input 50*b* contacts. In these particular implementations, the hot input line 60*a* is coupled to the neutral input contact 50*b* and the neutral output contact 52*b* is electrically coupled to the hot input contact 50*a* so that the hot output 53*a* can only be electrically coupled with the hot input line 60*a* through the neutral input and output contacts 50*b*, 52*b*. FIG. 11 is a representative circuit diagram illustrating the concept that both safety tabs need to actuate the output contacts 52*a*, 52*b* which act as switches S1 and S2 in combination with the input contacts 50*a*, 50*b*, for power to reach the hot plug aperture.

It will be understood that this type of arrangement may be used for any of the implementations shown or described in this disclosure even if in some implementations slight adaptation of the structure may be needed. Those of ordinary skill in the art will readily understand how to adapt the various implementations disclosed or known in the art to include the safety switching explained herein.

It will also be understood that the internal circuitry in any implementation may be configured such that electrical current may flow through the one or more output contacts only when an electrical circuit is completed between the one or more input contacts and an associated output contact as a result of the respective hot input contact and hot output contact, and the respective neutral input contact and neutral output contact are in electrical communication. Without electrically conductive contact between both of those respective contacts, electrical power cannot be provided to the plug 24 through the safety outlet. It will be understood that use of the terms "electrical communication," "electrically conductive contact," and "electrically coupled" are intended only to imply that there is a continuous electrically conductive path between two components and not that they are at the time necessarily conducting electricity or that they are directly in contact with each other.

Figure 3:
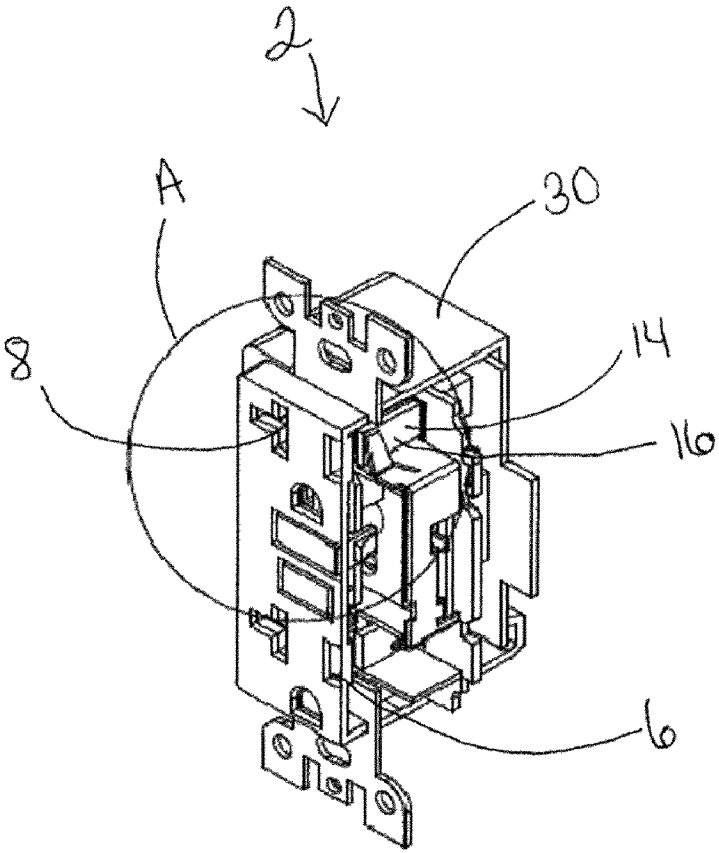
FIG. 3 is a cut-away perspective view of a particular implementation of a safety outlet.
Figure 2:
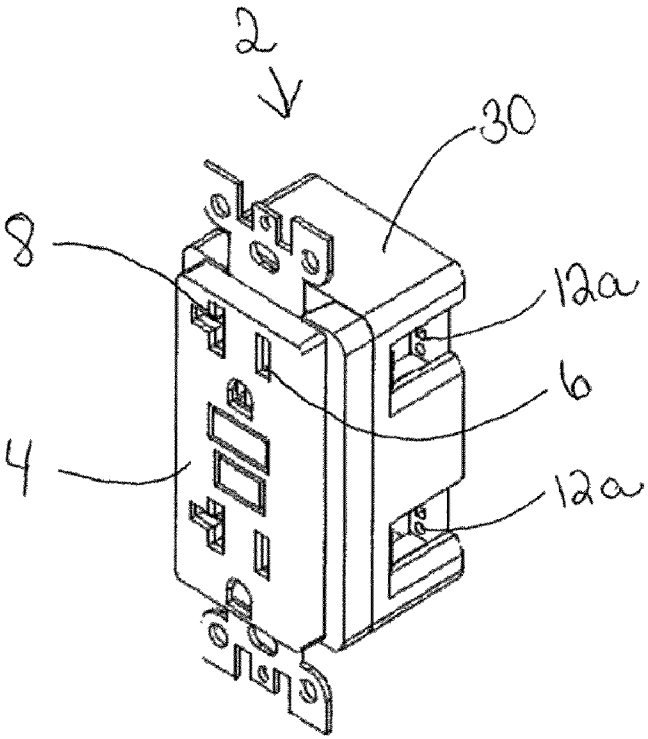
FIG. 2 is an assembled perspective view of a particular implementation of a safety outlet.
Figure 4:
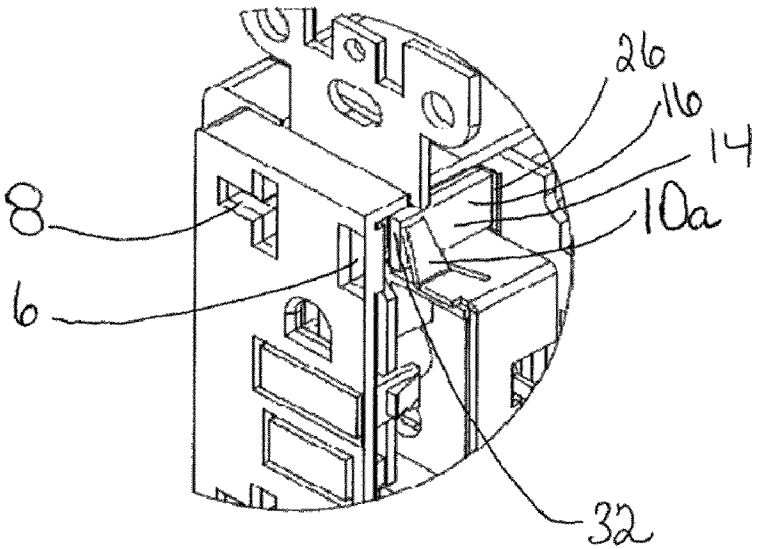
FIG. 4 is a detail view of detail section "A" of FIG. 3.

For the particular implementation illustrated by FIGS. 3 and 4, when one or more safety tabs 14 is in the engaged position 16, the one or more safety tabs 14 is between its respective output contacts 10*a*, 10*b* and/or input contacts 12*a* or 12*b*, such that a respective hot plug blade circuit and/or a respective neutral plug blade circuit is not completed. By contrast, when one or more safety tabs 14 is in the disengaged position 18, the one or more safety tabs 14 is removed and allows electrically conductive contact between its respective input contact 12*a* or 12*b* and output contact 10*a* or 10*b*.

As described further with respect to FIGS. 5 and 6, the one or more safety tabs 14 are operatively responsive to move from their engaged position 16 to the disengaged position 18 when an electrical plug blade 20*a* or 20*b* is positioned within a respective hot plug blade aperture 6 and a respective neutral plug blade aperture 8. In some particular implementations, one or more safety tabs 14 are slidably positionable between the engaged position 16 and the disengaged position 18. In other particular implementations, a portion of each of the one or more safety tabs 14 may pass through a guide slot 26. In still other particular implementations, one or more safety tabs may be biased to the engaged position 16. In still yet other particular implementations, one or more safety tabs may be pivotably positionable between the engaged position and the disengaged position such that when the plug blade is pushed against the safety tab it pivots rather than slides to allow or cause the respective input contacts and output contacts to come into electrically conductive contact.

It will be understood that in particular implementations, such as those shown in FIGS. 1-8, the one or more safety tabs 14 are independently positionable such that a first safety tab 14 (such as, by way of non-limiting example, one or more safety tabs 14 associated with the hot contacts) may be moved between an engaged position 16 and a disengaged position 18 (and vice-versa) without concomitantly moving a second safety tab 14 (such as, by way of non-limiting example, one or more safety tabs 14 associated with the neutral contacts). By allowing independent movement of the safety tabs 14 if a non-plug element is inadvertently placed in only one plug blade aperture electrical power is not provided to the plug through the safety outlet because the electrical circuit of the outlet is not completely activated.

Some particular implementations of a safety outlet may comprise a timing circuit 40. Depending upon the particular implementations being used, a timing circuit 40 may require that both a respective hot plug blade circuit and respective neutral plug blade circuit be completed within a given time interval in order to energize the output contacts. In such particular implementations, a timing circuit 40 and one or more additional switches (not shown) may be provided to allow or preclude a relay or other solid state device to energize a hot conductor. The one or more switches may be any type of switches suitable for the presently intended applications, including SPDT switches that may be configured, for example, to shut off one or more output contacts 10*a*, 10*b* and/or one or more input contacts 12*a* or 12*b*, as well. Those of ordinary skill in the art will readily understand the scope and types of switches that may be used from the disclosure provided herein. In addition to the foregoing, in some particular implementations, one or more alarms (included within timing circuit 40) may be provided in order to indicate when any less than at least one of the one or more safety tabs 14 associated with each of the hot plug blade aperture 6 and the neutral plug blade aperture 8 is moved to the disengaged position 18 and the circuit has or has not been energized. Accordingly, an alarm may be configured to alert a person or other entity that a fault has been attempted and/or occurred. Non-limiting examples of alarms may include light alarms, LED's, audible alarms, and/or remotely-transmitted alarms.

Referring specifically to FIGS. 5 and 6, a non-limiting exemplary method of activating a safety electrical outlet is described. The method comprises inserting, with respect to a safety outlet 2, an electrical plug 24 having at least two plug blades 20*a* and 20*b* (which may comprise at least a hot plug blade 20*a* and a neutral plug blade 20*b* (hidden)), so that one plug blade 20*a* or 20*b* is inserted into each of a hot plug blade aperture 6 and a neutral plug blade aperture 8 of the safety outlet 2. A hot safety tab 14 located between a hot output contact 10*a* and a hot input contact 12*a* of the hot plug blade aperture 6 is moved to cause contact between the hot output contact 10*a* and the hot input contact 12*a* of the hot plug blade aperture 6 in response to the inserting the hot plug blade 20*a* into the hot plug blade aperture 6. In addition, the method includes moving a neutral safety tab 14 located between an neutral output contact 10*b* and a neutral input contact 12*b* of the neutral plug blade aperture 8 into contact with the neutral output contact 10*b* and the neutral input contact 12*b* of the neutral plug blade aperture 8 in response to the inserting the neutral plug blade 20*b* (hidden) into the neutral plug blade aperture 8. An electrical circuit is completed between the respective input contact 12*a* or 12*b*, plug blade 20*a* or 20*b*, and output contact 10*a*, 10*b* of each of the hot plug blade aperture 6 and the neutral plug blade aperture 8. Additionally, current is conducted from the safety outlet 2 to the electrical plug 24 when both the hot plug blade circuit and the neutral plug blade circuit are both completed.

It will be understood that the step of completing an electrical circuit between the respective input contact 12*a* or 12*b*, and output contact 10*a*, 10*b* of each of the hot plug blade aperture 6 and the neutral plug blade aperture 8 includes selectively mating a plug blade 20*a* or 20*b* with the respective plug blade aperture 6 or 8 such that an end 30 of the plug blade 20*a* or 20*b* presses against a first end 32 of the safety tab 14. As a plug blade 20*a* or 20*b* pushes upon a safety tab 14, the safety tab 14 moves to its disengaged position 18

It will be understood by those of ordinary skill in the art that the concept of a safety outlet, as disclosed herein, is not limited to the specific implementations shown herein. For example, it is specifically contemplated that the components included in a particular implementation of a safety outlet may be formed of any of many different types of materials or combinations that can readily be formed into shaped objects and that are consistent with the intended operation of a safety outlet. For example, the components may be formed of: rubbers (synthetic and/or natural) and/or other like materials; polymers and/or other like materials; plastics, and/or other like materials; composites and/or other like materials; metals and/or other like materials; alloys and/or other like materials; and/or any combination of the foregoing.

Furthermore, the electrical outlets, hot plug blade apertures, neutral plug blade apertures, output contacts, input contacts, safety tabs, hot safety tabs, neutral safety tabs, disengaged positions, engaged positions, hot plug blade circuits, neutral plug blade circuits; electrical plugs, electrical plug blades, timing circuits, alarms, ground fault interrupter assemblies, base boxes, through slots, and implementing components and any other components forming a particular implementation of a safety outlet may be manufactured separately and then assembled together, or any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled or removably coupled with one another in any manner, such as with adhesive, a weld, a fastener, any combination thereof, and/or the like for example, depending on, among other considerations, the particular material(s) forming the components.

It will be understood that particular implementations are not limited to the specific components disclosed herein, as virtually any components consistent with the intended operation of a method and/or system implementation for a safety outlet may be utilized. Accordingly, for example, although particular electrical outlets, hot plug blade apertures, neutral plug blade apertures, output contacts, input contacts, safety tabs, hot safety tabs, neutral safety tabs, disengaged positions, engaged positions, hot plug blade circuits, neutral plug blade circuits; electrical plugs, electrical plug blades, timing circuits, alarms, ground fault interrupter assemblies, base boxes, through slots, and implementing components may be disclosed, such components may comprise any shape, size, style, type, model, version, class, grade, measurement, concentration, material, weight, quantity, and/or the like consistent with the intended operation of configurable electrical box and a method and/or system implementation for a safety outlet may be used.

In places where the description above refers to particular implementations of a safety outlet, it should be readily apparent that a number of modifications may be made without departing from the spirit thereof and that these implementations may be applied to other configurable electrical boxes. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A safety outlet comprising:

an electrical outlet having:

at least a hot plug blade aperture comprising a hot output contact and a hot input contact normally not in electrically conductive contact, and a hot safety tab;

at least a neutral plug blade aperture comprising a neutral output contact and a neutral input contact normally not in electrically conductive contact, and a neutral safety tab;

wherein the hot safety tab is operatively responsive to an electrical plug blade being pushed into the hot plug blade aperture, the hot safety tab responsive to move from an engaged position in which the associated hot output contact and hot input contact are not in electrically conductive contact with each other, to a disengaged position in which the associated hot output contact and hot input contact are in electrically conductive contact with each other;

wherein the neutral safety tab is operatively responsive to an electrical plug blade being pushed into the neutral plug blade aperture, the neutral safety tab responsive to move from an engaged position in which the associated neutral output contact and neutral input contact are not in electrically conductive contact with each other, to a disengaged position in which the associated neutral output contact and neutral input contact are in electrically conductive contact with each other; and a timing circuit associated with the hot safety tab and configured such that if the hot safety tab is moved to its disengaged position in time relation to the neutral safety tab longer than a predetermined time interval, electrical power is not supplied to the hot plug blade aperture.

2. The safety outlet of claim 1, further comprising an alarm operatively associated with the hot safety tab, the alarm configured to indicate when the hot safety tab is not moved to its disengaged position within the predetermined time interval of the neutral safety tab being moved to its disengaged position.

3. The safety outlet of claim 1, wherein when the electrical plug blade is pushed into the hot plug blade aperture and the hot safety tab is in its disengaged position, the hot output contact and hot input contact are in electrical communication through the electrical plug blade.

4. The safety outlet of claim 1 wherein each of the respective safety tabs are independently moveable in relation to each other.

5. The safety outlet of claim 1 wherein each respective safety tab is slidably moveable between the engaged position and the disengaged position and biased to its engaged position.

6. A method of activating a safety electrical outlet, the method comprising:

inserting a blade of an electrical plug into each of a hot plug blade aperture and a neutral plug blade aperture of a safety electrical outlet; and moving a safety tab within each of the hot plug blade aperture and the neutral plug blade aperture from an engaged position to a disengaged position, wherein movement of no less than both safety tabs activates the safety electrical outlet.

7. The method of claim 6, wherein moving the safety tabs comprises:

completing a hot plug blade aperture circuit to activate the hot plug bade aperture by moving the safety tab located within the hot plug blade aperture in response to the plug blade inserted into the hot plug blade aperture, wherein moving comprises moving the safety tab within the hot plug blade from an engaged position wherein a hot output contact and a hot input contact are not in electrical communication, to a disengaged position wherein the hot output contact and hot input contact are in electrical communication; and completing a neutral plug blade aperture circuit to activate the neutral plug bade aperture by moving the safety tab located within the neutral plug blade aperture in response to the plug blade inserted into the neutral plug blade aperture, wherein moving comprises moving the safety tab within the neutral plug blade from an engaged position wherein a neutral output contact and a neutral input contact are not in electrical communication, to a disengaged position wherein the neutral output contact and neutral input contact are in electrical communication.

* * * * *